US007879301B2

(12) United States Patent
Sugioka

(10) Patent No.: US 7,879,301 B2
(45) Date of Patent: Feb. 1, 2011

(54) MICROFLUIDIC ELEMENT

(75) Inventor: Hideyuki Sugioka, Palo Alto, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 1016 days.

(21) Appl. No.: 11/113,139

(22) Filed: Apr. 25, 2005

(65) Prior Publication Data

US 2005/0249639 A1 Nov. 10, 2005

(30) Foreign Application Priority Data

Apr. 27, 2004 (JP) ..... 2004-131569

(51) Int. Cl.

| | |
|---|---|
| ***B01L 99/00*** | (2010.01) |
| ***B01L 3/00*** | (2006.01) |
| ***B01L 3/02*** | (2006.01) |
| ***G01N 1/10*** | (2006.01) |

(52) U.S. Cl. ..... 422/502; 422/504; 422/530; 436/180

(58) Field of Classification Search ..... 422/93, 422/97, 98, 99, 100, 101, 102, 122, 134, 422/219, 374; 73/1.02; 366/142, 144, 341; 210/198.3

See application file for complete search history.

(56) References Cited

U.S. PATENT DOCUMENTS

2004/0179427 A1 9/2004 Yamazaki et al. ..... 366/348

FOREIGN PATENT DOCUMENTS

| | | |
|---|---|---|
| JP | 3-113858 | 5/1991 |
| JP | 6-201898 | 7/1994 |
| JP | 10-337173 | 12/1998 |
| JP | 11-221583 | 8/1999 |
| JP | 2002-113475 A | 4/2002 |
| JP | 2003-164750 | 6/2003 |
| JP | 2004-053370 A | 2/2004 |
| JP | 2004-053545 A | 2/2004 |
| WO | WO 2004/009226 A1 | 1/2004 |

*Primary Examiner*—Jill Warden
*Assistant Examiner*—Dean Kwak
(74) *Attorney, Agent, or Firm*—Fitzpatrick, Cella, Harper & Scinto

(57) ABSTRACT

A fluid element is provided which comprises a flow path formed in a substrate for carrying a fluid, and a heating means provided in the flow path for heating the fluid, in which the fluid is heated using the heating unit, thereby forming a supercritical state of the fluid.

7 Claims, 6 Drawing Sheets

MICROFLUIDIC ELEMENT

BACKGROUND OF THE INVENTION

1. Field of the Invention

The present invention relates in general to a fluid element, and more particularly to a fluid element which is useful for treatment of a micro quantity of liquid in chemical analysis devices, medical devices, biotechnology devices, and the like. In particular, the present invention relates to a fluid element which is applied to microanalysis systems (μTAS: Micro Total Analysis Systems) for effecting chemical analysis or chemical synthesis on a chip, and more particularly to a fluid element which is applied to defusement (or making harmless) of harmful substances generated in the μTAS or the like, recovery and reuse of a raw material from a waste liquid, decomposition, dissolution, reaction acceleration, and the like.

2. Related Background Art

In recent years with development of three-dimensional microprocessing techniques, the systems attracting attention are those which have fluid elements such as a fine flow path, a pump, and a valve, and a sensor integrated on a substrate such as of glass or silicon, and conduct chemical analysis on the substrate. Such a system is called a microanalysis system, a μ-TAS (Micro Total Analysis System), or Lab on a Chip. The miniaturization of the chemical analysis system enables decrease of void volume and remarkable reduction in sample amount.

The miniaturization also enables shortening of the analysis time and a decrease in power consumption of the entire system. Further, the miniaturization is promising for price reduction of the system. Furthermore, the μ-TAS is promising in medical services such as home medical care and bedside monitoring, and biotechnology such as DNA analysis and proteomics analysis because it enables the miniaturization and price reduction of a system, and a remarkable shortening in analysis time.

Japanese Patent Application Laid-open No. H10-337173 discloses a micro-reactor capable of implementing a sequence of biochemical experiment steps of mixing solutions to cause reaction, analyzing quantitatively the reaction product, and separating the product, by using combination of cells. The micro-reactor has isolated reaction chambers each closed tightly with a flat plate on a silicon substrate. This micro-reactor has a reservoir cell, a mixing cell, a reaction cell, a detection cell, and a separation cell combined with each other. By providing such a reactor in plurality on a substrate, many biochemical reactions can be allowed to proceed simultaneously concurrently. Furthermore, not only the analysis but also material synthesis such as protein synthesis can also be conducted in the cells.

On the other hand, in circumstances in which tackling environmental issues becomes essential, a waste liquid treating technique using supercritical water has been proposed as a technique enabling harmful organic substances such as dioxin to be perfectly decomposed.

There is disclosed a technique for effectively making a waste liquid harmless without increasing a quantity of heavy metal ions by utilizing a waste liquid treating method in which an aqueous waste liquid containing an organic substance capable of forming a water-soluble complex with heavy metal ions is heated together with oxygen under pressure using a container made of titanium such that the temperature becomes 375° C. or more, and the partial pressure of water becomes 230 atm or more (see Japanese Patent Application Laid-open No. H03-113858).

In addition, a technique is proposed in which a waste liquid containing tetramethylammonium hydrooxide (TMAH) is subjected to supercritical water oxidation by using oxygen or hydrogen peroxide as an oxidizer under the conditions of a reaction temperature of 550 to 650° C. and a reaction pressure of 23 to 25 MPa, thereby effectively decomposing the indecomposable TMAH contained in a waste liquid from a semiconductor manufacturing plant (see Japanese Patent Application Laid-open No. H11-221583).

In addition, a chemical decontamination waste liquid treating method is proposed in which an organic acid separated and concentrated at an anode, especially, a chelating agent is decomposed using supercritical water (see Japanese Patent Application Laid-open No. H06-201898).

Also, a method of treating an analysis waste liquid is proposed in which an analysis waste liquid and an emulsifying agent are mixed with each other to form an emulsion, and the resultant emulsion is then discomposed using supercritical water (see Japanese Patent Application Laid-open No. 2003-164750).

Currently, in the field of analysis, there is a tendency that works for analyzing harmful substances such as dioxin increase due to growing interest in the environmental issues, so that treatment of an analysis waste liquid containing harmful substances becomes an important task. However, in the conventional μTAS, the circumstance has been that any system including waste liquid treating means effective for decomposing the harmful substances has not been proposed, and hence the harmful analysis waste liquid has been difficult to dispose of. In addition, because the prior art treatment system utilizing supercritical water requires such a high temperature as 374° C. or more and such a high pressure as 22 MPa or more, the treatment system should be called a large equipment and hence is difficult to miniaturize.

On the other hand, WO 2004/009226 discloses a chemical analysis method of effecting chemical analysis and chemical synthesis using a plurality of liquids on a substrate having a flow path, a fluid element, and a detection element, in which the plurality of liquids are stirred and mixed with one another by utilizing expansion and shrinkage of bubbles. In the chemical analysis method disclosed in WO 2004/009226, bubbles are generated using a heating element. However, WO 2004/009226 does not disclose the formation of the supercritical state.

SUMMARY OF THE INVENTION

The present invention has been accomplished in the light of the prior art described above, and it is, therefore, an object of the present invention to provide a micro fluid element having a function of promoting decomposition treatment and defusement of harmful substances such as an analysis waste liquid generated in μTAS or the like.

According to one aspect of the present invention, there is provided a fluid element, comprising:

a flow path formed in a substrate for carrying a fluid; and a heating means provided in the flow path for heating the fluid, wherein the fluid is heated using the heating means to form a supercritical state of the fluid.

In the present invention, it is preferred that the flow path has a high inertance for the heating means.

Further, it is preferred that the supercritical state is formed by applying to the heating means a voltage pulse with a pulse width t0 represented by the general equation (1):

$$t0<((2ASHd0)/\Delta P)^{0.5}$$

where A represents an inertance of the flow path for the heating means; Sh represents an area of the heating means; d0 represents a fluid movement allowance and is 1 μm; and ΔP represents a pressure difference and is 22 MPa.

Moreover, it is preferred that the fluid element further comprises a liquid chamber containing the heating means and connected to the flow path, wherein the supercritical state is formed by applying to the heating means a voltage pulse with a pulse width t0 represented by the general equation (2):

$$t0<((2\rho Ld0G)/\Delta P)^{0.5}$$

where ρ represents a density of the fluid; L represents a length of the flow path; d0 represents a fluid movement allowance and is 1 μm; G satisfies the condition of G=Sh/S>1 (where Sh represents an area of the heating means and S represents a cross-sectional area of the flow path); and ΔP represents a pressure difference and is 22 MPa.

Further, it is preferred that the fluid element further comprises means for effecting heat storage/heat radiation connected to the heating means, wherein heat storage and heat radiation are repeatedly carried out to repeatedly form the supercritical state.

Moreover, it is preferred that the fluid element further comprises an insulating thin film provided in contact with the heating means, wherein the heating means comprises a resistor thin film, and wherein the insulating thin film has a thickness d fulfilling the general equation (3):

$$(vt0)^{0.5}<d<4(vt0)^{0.5}$$

where t0 represents a pulse width of a voltage pulse applied to the resistor thin film, and v represents a thermal diffusivity of the insulating thin film.

Further, it is preferred that the fluid element further comprises a first electrode and a second electrode in the flow path, wherein a voltage is applied between the first and the second electrodes to form an electric field in the flow path, thereby effecting heating.

Moreover, it is preferred that the fluid is held between a plurality of the heating means, and a pulse voltage is applied to the heating means, thereby forming the supercritical state.

DESCRIPTION OF THE PREFERRED EMBODIMENTS

The present invention will hereinafter be concretely described by giving preferred embodiments.

First Embodiment

Figure 1:
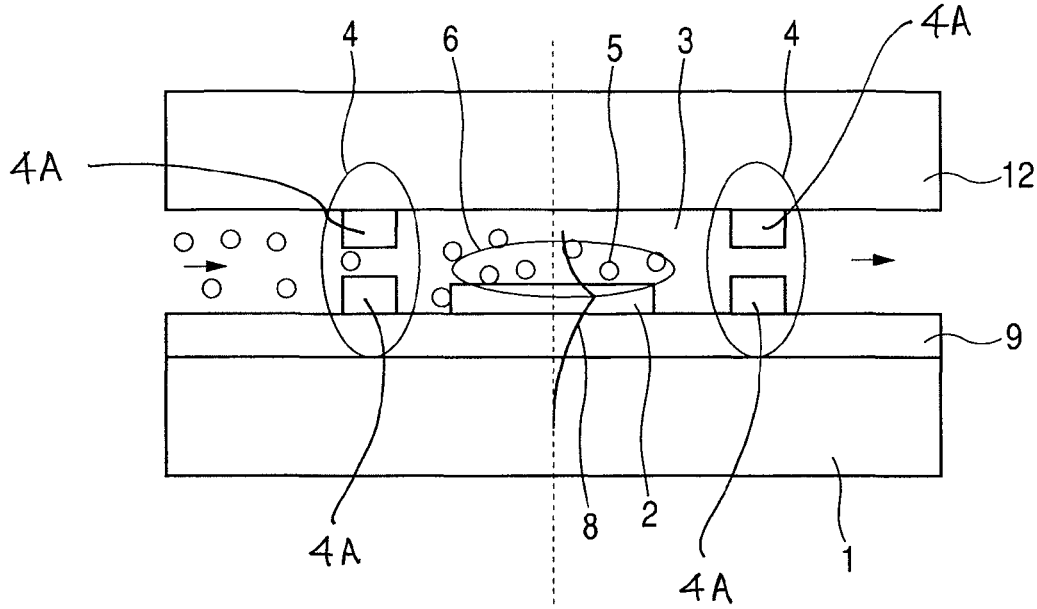
FIG. 1 is a schematic view showing a fluid element according to a first embodiment of the present invention.

FIG. 1 is a schematic view showing the feature of a fluid element according to a first embodiment of the present invention. In FIG. 1, reference numeral 1 designates a Si substrate, reference numeral 2 designates a resistor thin film as heating means, reference numeral 3 designates a flow path, reference numeral 5 designates a conceptually shown harmful substance, and reference numeral 6 designates a region of generation of a supercritical state. In addition, reference numeral 4 designates a high inertance flow path, reference numeral 9 designates an $SiO_2$ film, and reference numeral 8 designates a conceptual diagram of temperature distribution when a voltage is applied to the resistor thin film heating means 2.

That is, the present invention offers an effect in which it is possible to provide a micro fluid element having, within the same substrate, a flow path and a heating means provided in the flow path, and including a function with which a supercritical state is formed by heating a fluid using the heating means, thereby making it possible to promote decomposition treatment and defusement of harmful substances such as an analysis waste liquid generated in the μTAS or the like. The reason is that because the fluid cannot immediately move during the heating in such a minute flow path as to be formed within the same substrate, the supercritical state can be attained without scaling up a system.

In addition, the present invention especially offers an effect in which it is possible to provide a micro fluid element including a function with which the micro fluid element has the high inertance flow path 4 having an intentionally reduced cross-sectional area for the heating means 2, through the presence of flow restrictors 4A, to more surely prohibit a fluid from immediately moving during the heating, thereby making it possible to promote decomposition treatment and defusement of harmful substances such as an analysis waste liquid generated in the μTAS or the like.

The expression "inertance", as described in "IEEE Standard Dictionary of Electronics Terms", generally represents a value which is obtained by dividing a potential difference such as a pressure difference by a change in flow rate related thereto. However, the term "inertance" as herein employed is intended to mean an inertial mass of a fluid, and more specifically, represents, for example, a value of ρL/S where ρ represents a density of a fluid; L represents a length of a flow path; and S represents a cross-sectional area of the flow path.

In addition, the present invention especially offers an effect in which it is possible to provide a micro fluid element having the resistor thin film heating means 2 with an area Sh, and the flow path having the inertance becoming at least A for the heating means, and including a function with which a voltage pulse of a pulse width t0 which, when a pressure difference ΔP=22 MPa and a fluid movement allowance d0=1 μm, satisfies the condition of $t0<((2AShd0)/\Delta P)^{0.5}$, more preferably the condition of $t0<0.5((2AShd0)/\Delta P)^{0.5}$ is applied to the resistor thin film heating means 2 to form a supercritical state to more surely prohibit the fluid from immediately moving during the heating, thereby making it possible to promote decomposition treatment and defusement of harmful substances such as an analysis waste liquid generated in the μTAS or the like.

Here, when the inertance of the flow path is assigned A, a flow resistance is assigned B, a volume displacement is assigned V, and a pressure difference is assigned ΔP, the motion in the flow path is approximately expressed by the equation:

$$Ad^2V/dt^2+BdV/dt=\Delta P.$$

Thus, when it is supposed that dV/dt=0 is established at a time t=0, and ΔP=0 is established at a time t<0, the step response of the fluid system is expressed by the equation:

$$dV/dt=(\Delta P/B)(1-\exp(-t/\tau)),$$

where a time constant τ is τ=A/B. When t~0 is established, because the above equation is linearized as $$dV/dt=(\Delta P/B)(1/\tau)t,$$

an amount of volume movement until a time t is expressed as follows:

$$V=0.5(\Delta P/B)(1/\tau)t^2=\Delta P/(2A)t^2.$$

Consequently, it can be seen that in order to force the fluid into a supercritical state by utilizing the difficulty of the fluid to move resulting from the inertance of the flow path, if the heating is generally carried out at time intervals fulfilling the following equation, the fluid reaches a supercritical state before its volume expansion during the heating:

$$\Delta P/(2A)t^2/Sh<d0,$$

where d0 represents a fluid movement allowance in which fluid existing in the vicinity of a surface of a heater forms no bubbles.

Bubble formation at a surface is a phenomenon in which a liquid which exists in the vicinity (normally, a thickness of about 0.2 to 1.0 μm) of a surface of a heater and which is heated up to a vicinity of a spinodal boundary abruptly changes from liquid phase to gaseous with volume change. If it is supposed that the movement allowance d0 of the liquid is 1 μm, the liquid can hardly move for the heating within a time period determined by the above equation and hence cannot form any bubble, so that the injected heat energy is used for temperature rise and pressure increase, and thus the supercritical water state can be realized.

Figure 2:
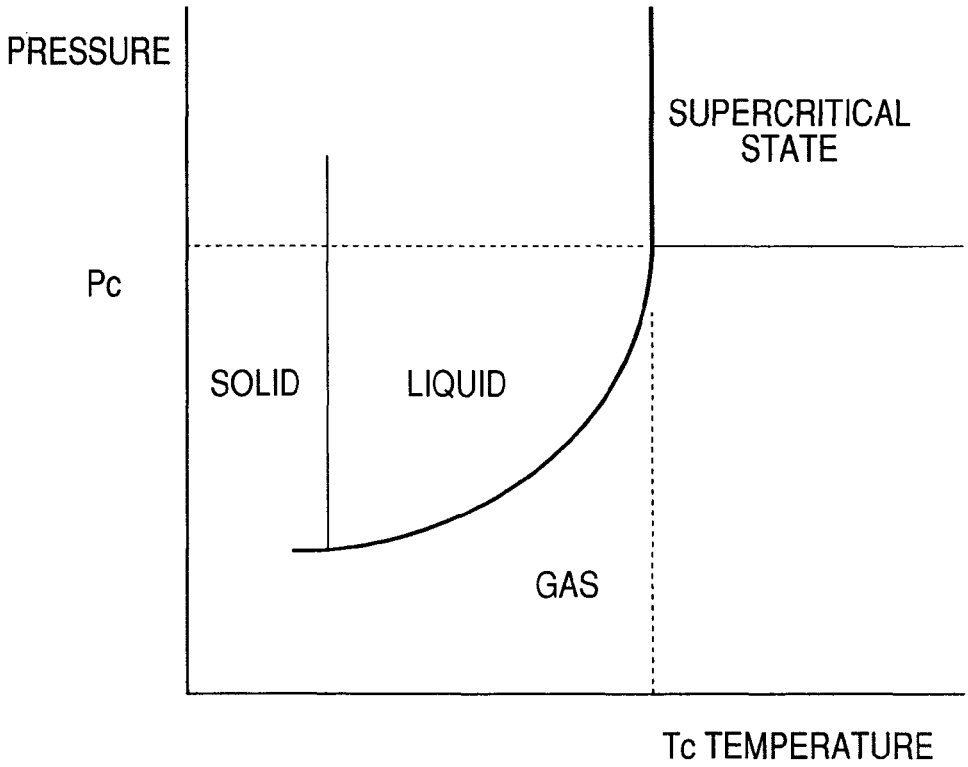
FIG. 2 is a graphical representation showing a supercritical state.

FIG. 2 is a graphical representation for explaining the supercritical state. When the temperature is raised up to 374° C. and the pressure is increased up to 22 MPa, water goes into a supercritical state. A supercritical fluid is defined as a non-condensable high density fluid which lies in a temperature/pressure region exceeding a gas-liquid critical point as a state point specific to a substance. The features of the supercritical fluid are such that the thermal motion of molecules is violent, and the density can be continuously changed from a rarefied state close to an ideal gas to a high density state corresponding to a liquid, and thus the equilibrium/transport physical properties expressed as a function of density can be controlled. In contrast to a normal liquid which does not change in density so much even when the pressure is changed, in the supercritical fluid, a minute change in pressure exerts a large influence on the properties of the fluid.

Figure 3:
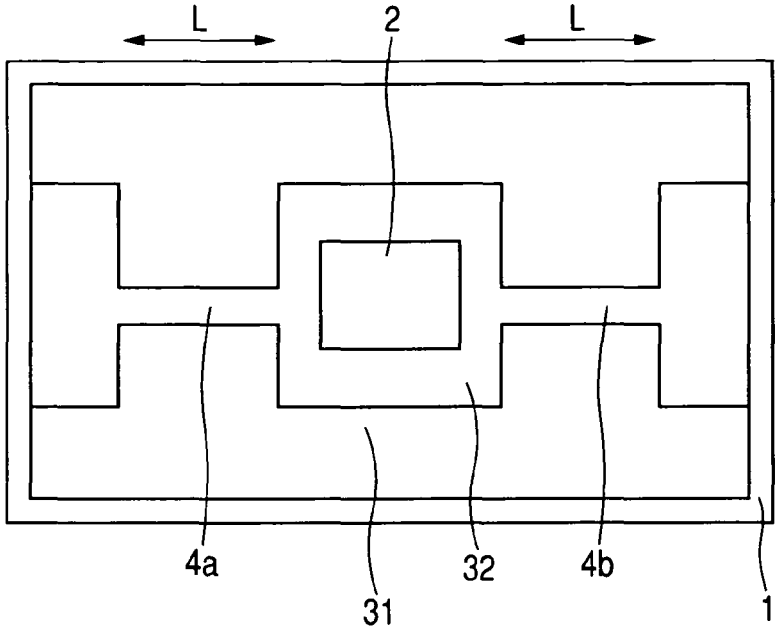
FIG. 3 is a schematic view showing a planar construction of the fluid element according to the first embodiment of the present invention.

FIG. 3 is a schematic plan view showing a fluid element according to a first embodiment of the present invention. Reference numeral 31 designates a wall member of the flow paths. The first embodiment especially offers an effect in which it is possible to provide a micro fluid element having a liquid chamber 32 including the fluid with a density ρ and the resistor thin film heating means 2 with an area Sh to which flow paths 4*a* and 4*b* each having a cross-sectional area S and a length L fulfilling a condition of G=Sh/S are connected, and including a function with which a voltage pulse with a pulse width t0, when a pressure difference ΔP=22 MPa and a fluid movement allowance d0=1 μm, satisfies $t0<((2\rho Ld0G)/\Delta P)^{0.5}$ and more preferably $t0<0.5((2\rho Ld0G)/\Delta P)^{0.5}$ is applied to the resistor thin film heating means 2 to form a supercritical state to thereby prohibit the fluid from immediately moving during the heating, thereby making it possible to promote decomposition treatment and defusement of harmful substances such as an analysis waste liquid generated in the μTAS or the like.

Here, when it is supposed that $\rho=1{,}000\ kg/m^3$, ΔP=22 MPa, L=500 μm, and G=1, the pulse width t0 of the voltage pulse is t0<0.213 μs and more preferably t0<0.1065 μs.

In addition, when it is supposed that G=Sh/S>1, an effect is obtained in which the pulse width is made larger without increasing the inertance. For example, when it is supposed that G=Sh/S=4, the pulse width t0 of the voltage pulse is t0<0.426 μs and more preferably t0<0.213 μs.

For example, when it is supposed that G=Sh/S=16, the pulse width t0 of the voltage pulse is t0<0.852 μs and more preferably t0<0.426 μs.

In this embodiment, each of the flow paths 4*a* and 4*b* is a flow path with a height of 10 μm and a width of 10 μm, and with a cross-sectional area S of 10 μm×10 μm, and the heater 2 has an area Sh of 40 μm×40 μm.

In particular, there is obtained an effect that it is possible to provide a micro fluid element having a heating means, flow paths each having a high inertance during the heating, and heat storage/heat radiation means connected to the heating means, and including a function with which rapid heating and heat radiation are repeatedly carried out to repeatedly form a supercritical state, thereby making it possible to promote decomposition treatment and defusement of harmful substances such as an analysis waste liquid generated in the μTAS or the like without increasing the temperature and pressure of the overall system.

In particular, when the heating means is the resistor thin film 2, and when a pulse width of a voltage pulse applied to the resistor thin film 2 is represented by t0 and the insulating thin film 9 (see FIG. 1) of a thermal diffusivity v provided in contact with the resistor thin film 2 has a film thickness fulfilling the equation of $(vto)^{0.5}<d<4(vto)^{0.5}$, there is obtained an effect that it is possible to realize a state in which both heating and cooling can be carried out easily, whereby rapid heating and heat radiation can be carried out at a high frequency.

Here, when it is supposed that t0=0.4 μs, the insulating thin film 9 is an $SiO_2$ film, and $v=0.852\times10^{-6}\ m^2/s$, the film thickness d of the insulating thin film 9 is 0.584 μm<d<2.336 μm.

Here, if the film thickness d of the insulating thin film 9 is large, there is a tendency to be hard to cool down, and thus the fluid causes volume expansion after passing through the supercritical state. That is, after passing through the supercritical state, the fluid is accompanied by bubble generation and elimination. When there are bubble generation and elimination after passing through the supercritical state, there is obtained an effect that the decomposition of harmful substances is promoted by cavitation.

On the other hand, if the film thickness d of the insulating thin film 9 is small, there is a tendency to be easy to cool down, and after passing through the supercritical state, there is a tendency for the temperature and the pressure to decrease before causing significant volume expansion. When the fluid is not accompanied by bubble generation and elimination, there is an effect that the surface of the heater is hard to be damaged by cavitation.

Here, the heater 2 is a TaN thin film with a thickness of about 50 nm, and a rectangular pulse voltage of 10 to 30 V is applied at a period of 1 to 100 kHz. In addition, the substrate 1 is a good conductor of heat and is a Si substrate in this embodiment.

Here, by way of precaution, the difference in principle of the bubble formation between the present invention and the technique disclosed in WO 2004/009226 or an ink jet recording apparatus using a heating element will be described with reference to FIG. 10 and FIGS. 11A and 11B.

Figure 10:
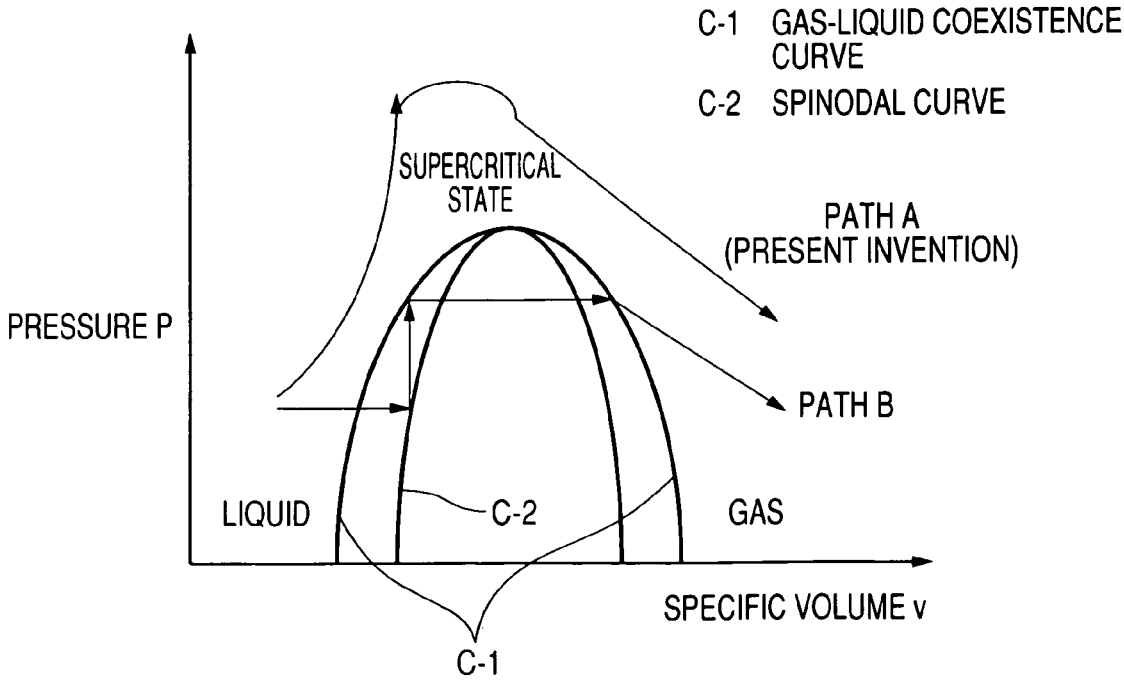
FIG. 10 is a graphical representation for explaining the principles of the present invention.
Figure 11A:
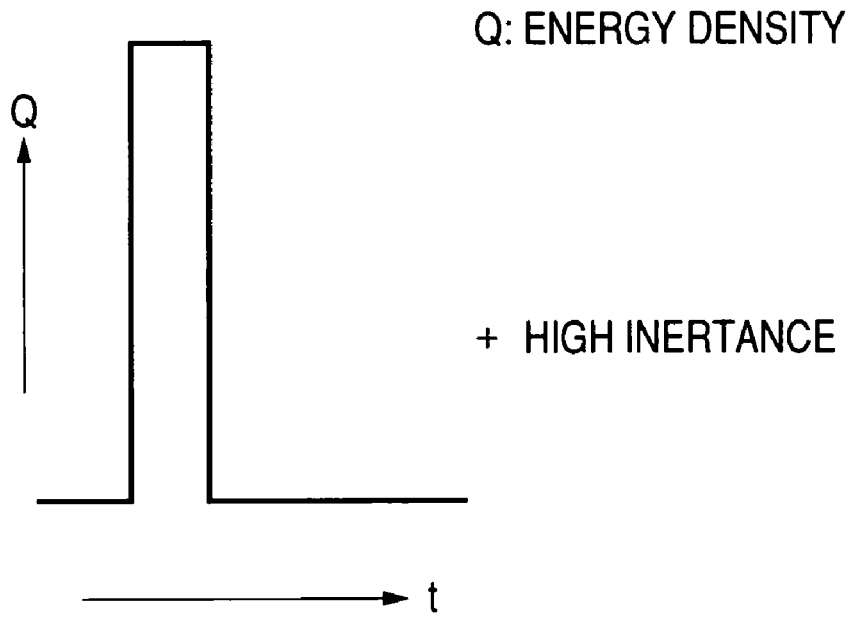
FIGS. 11A and 11B are schematic diagrams for explaining the principles of the present invention.
Figure 11B:
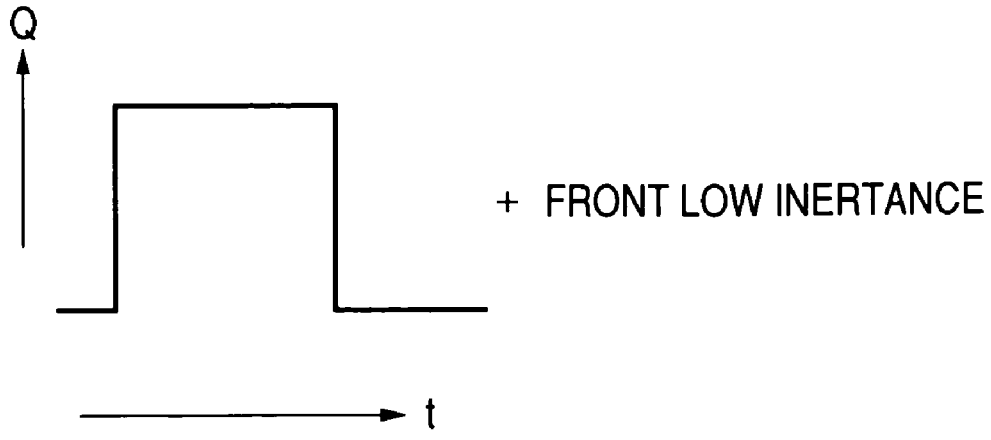

FIG. 10 and FIGS. 11A and 11B are schematic diagrams for explaining the principle of the present invention. In FIG. 10, a path A shows a relationship between the specific volume (v) and pressure (P) in the present invention, and a path B shows a path of bubble formation in the ink jet recording apparatus or the like using a heating element. In addition, in FIG. 11A, energy density Q in the present invention is plotted against time t, and in FIG. 11B, energy density Q is similarly plotted against time t with respect to the bubble formation in the ink jet recording apparatus or the like.

The key features of the present invention are such that the inertance when viewed from the heating surface is made very large, and pulses having a peak-to-peak with higher energy density than that in the ink jet recording apparatus is applied for a short period of time. In the present invention, as shown in the path A of FIG. 10, because the inertance is very large, an increase in specific volume is suppressed, and the pressure abruptly increases to attain the supercritical state before a large variance in the specific volume occurs.

On the other hand, in the ink jet recording apparatus which employs a heating element in which an increase in pressure due to bubble formation at about 300° C. is utilized to discharge a liquid droplet, it is generally essential to effect a state change so as to follow the path B shown in FIG. 10. More specifically, as shown in FIG. 11B, pulses with a lower energy density than that in the present invention is applied to make the front inertance small. Thus, as shown in the path B of FIG. 10, at first, the specific volume is caused to increase in a state in which no increase in pressure is caused. Then, the abrupt pressure increase which can be said to be explosive is caused by utilizing prohibition of an increase in specific volume at a point where the path B goes over a gas-liquid coexistence curve (C-1) and reaches the spinodal (limit) curve (C-2). Then, the front inertance needs to be reduced such that the liquid of a heated portion can abruptly change into a gas at the point where the path B reaches the gas-liquid coexistence curve (C-1). That is, the bubble formation technique in the general ink jet recording apparatus using a heating element is considered to be established on a condition that at least one of the front inertance and the back inertance is low to some extent (normally, the front inertance is a low inertance).

Second Embodiment

Figure 4:
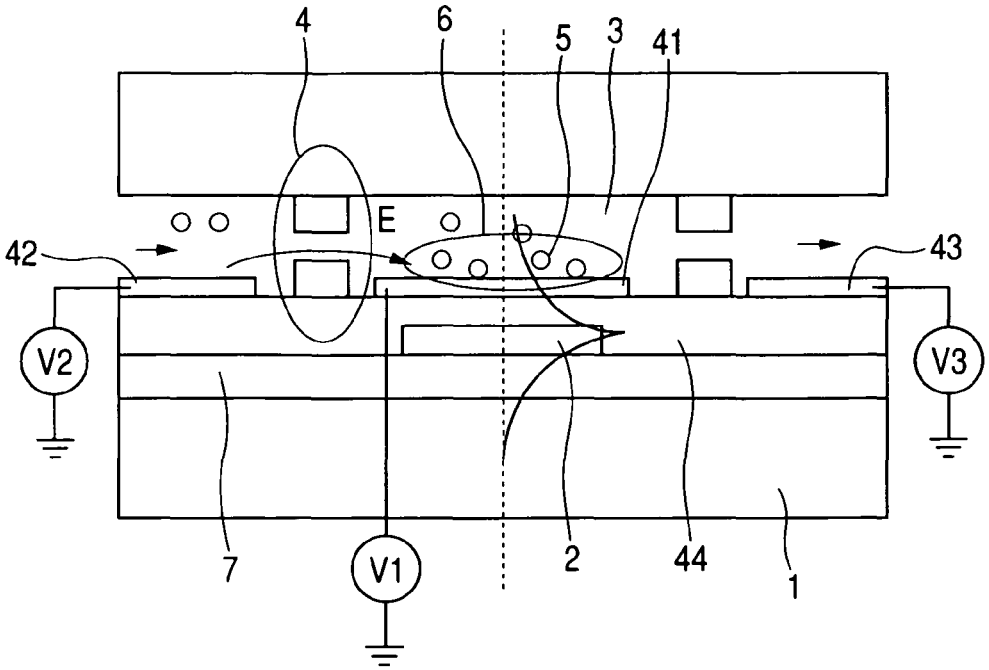
FIG. 4 is a schematic view showing a fluid element according to a second embodiment of the present invention.

FIG. 4 is a schematic view showing a fluid element according to a second embodiment of the present invention. In FIG. 4, reference symbols V1, V2, and V3 designate power supplies, respectively, reference numerals 41, 42, and 43 designate first, second, and third electrodes, respectively, and reference numeral 44 designates an SiN insulating thin film with a thickness of 0.3 μm.

In particular, the fluid element of this embodiment is nearly the same as that of the first embodiment with the exception that the fluid element has the first electrode 41 disposed in the vicinity of the heating means within the flow path and the second electrode 42 disposed within the flow path and that a suitable voltage is applied between the first and the second electrodes 41 and 42 to form an electric field within the flow path to thereby collect an electrolyte in the vicinity of the heating means, and in this state the surface heating is carried out.

Because there is a tendency that the supercritical state is realized in the vicinity of the heating means where a high temperature is easy to obtain, when the electrolyte is collected in the vicinity of the first and the second electrodes 41 and 42 by means of the electric field formed within the flow path and the surface heating is carried out in this state, the decomposition treatment can effectively be carried out.

Third Embodiment

Figure 5:
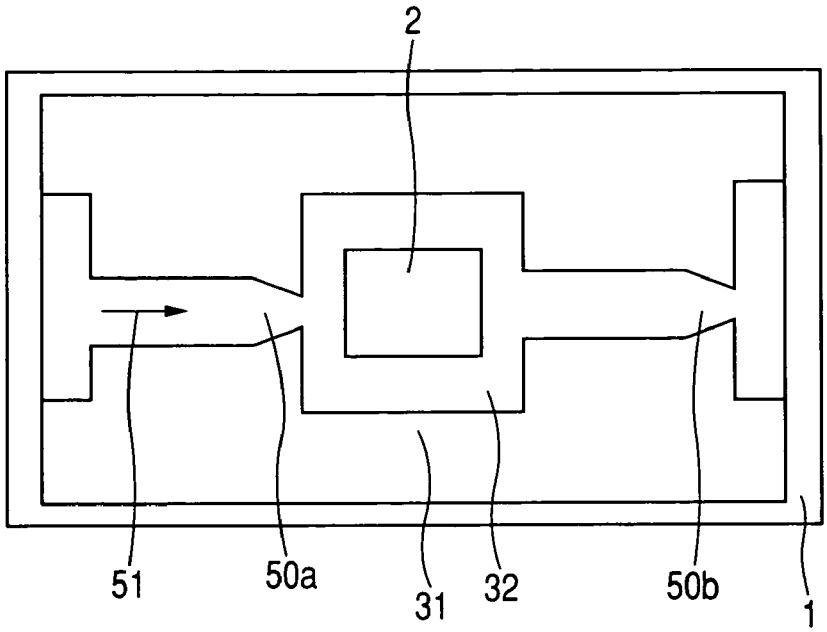
FIG. 5 is a schematic view showing a fluid element according to a third embodiment of the present invention.

FIG. 5 is a schematic view illustrating a feature of a fluid element according to a third embodiment of the present invention. The fluid element of the third embodiment is nearly the same as that of the first embodiment with the exception that each of flow paths 50*a* and 50*b* has a flow resistance with which the fluid is easy to flow in a specific direction. Reference numeral 51 designates the specific direction. When each of the flow paths 50*a* and 50*b* has the flow resistance with which the fluid is easy to flow in the specific direction 51, a net flow is generated in the specific direction 51 by a pressure generated when a suitable voltage is applied between the electrodes. Thus, there is obtained an effect that a pump function can be exhibited.

Fourth Embodiment

Figure 6:
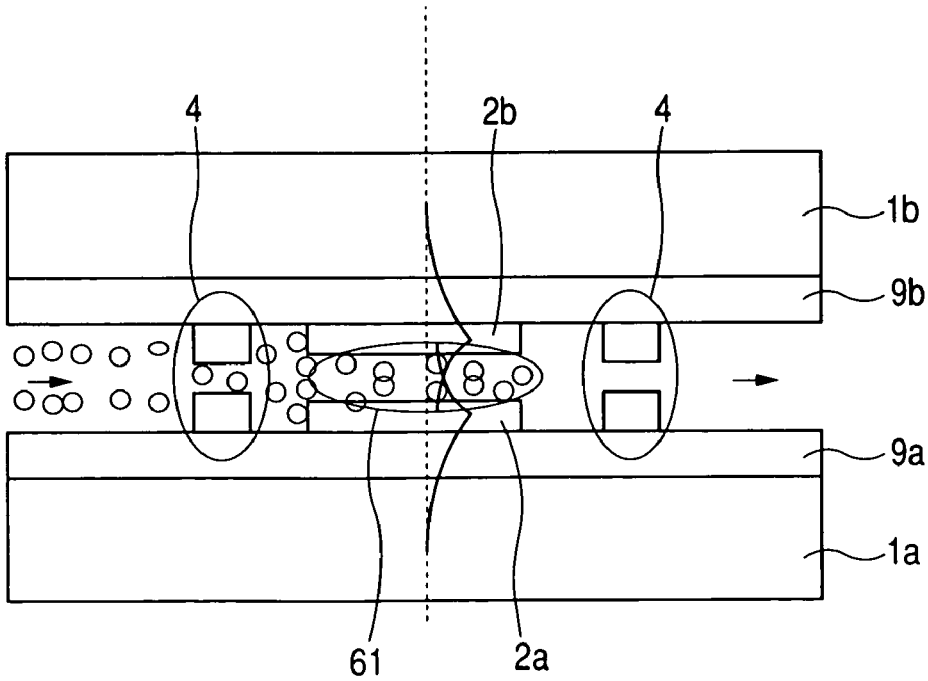
FIG. 6 is a schematic view showing a fluid element according to a fourth embodiment of the present invention.

FIG. 6 is a schematic view showing a fluid element according to a fourth embodiment of the present invention. The fluid element of the fourth embodiment is nearly the same as that of the first embodiment with the exception that the liquid is held between a plurality of resistor thin film heating means 2*a* and 2*b*, and a pulse voltage is applied across the resistor thin film heating means 2*a* and 2*b* to form a supercritical state region 61. Because the liquid is held between the plurality of resistor thin film heating means 2*a* and 2*b* to form the supercritical state, a larger volume of a supercritical state region 61 can be obtained. Hence, there is obtained an effect that the decomposition treatment can efficiently be carried out.

Fifth Embodiment

Figure 7:
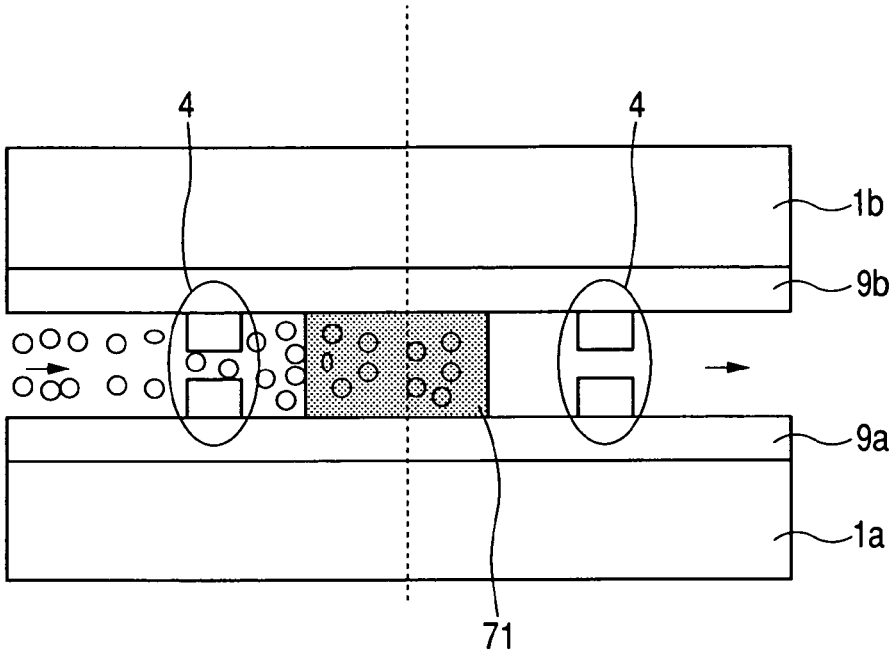
FIG. 7 is a schematic view showing a fluid element according to a fifth embodiment of the present invention.

FIG. 7 is a schematic view showing a fluid element according to a fifth embodiment of the present invention. The fluid element of the fifth embodiment is nearly the same as that of each of the first and the fourth embodiments with the exception that a pulse voltage is applied to a resistive heating means 71 having a mesh structure, thereby forming a supercritical state. Because the resistive heating means 71 of the mesh structure has an increased area of a surface contacting the liquid, the area of the surface for forming the supercritical state increases, whereby there is obtained an effect that the decomposition treatment can efficiently be carried out.

Sixth Embodiment

Figure 8:
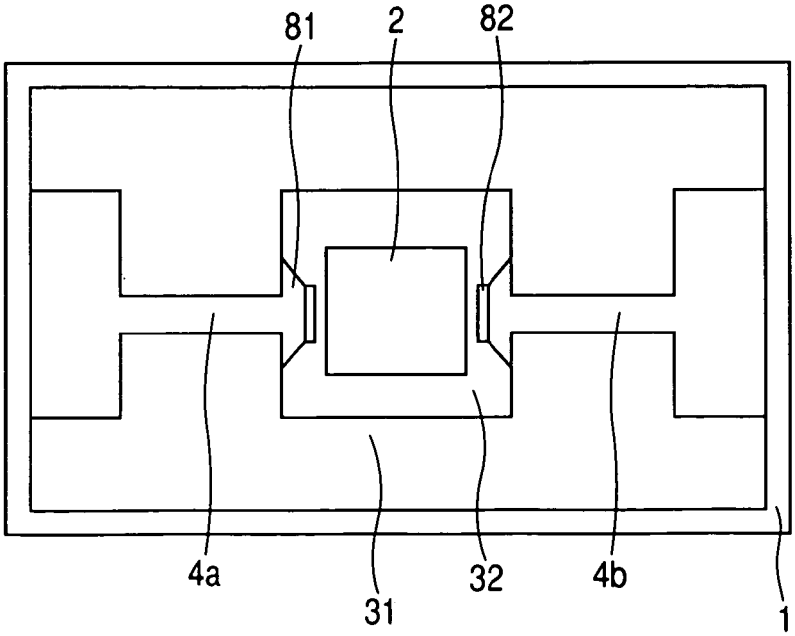
FIG. 8 is a schematic view showing a fluid element according to a sixth embodiment of the present invention.

FIG. 8 is a schematic view showing a fluid element according to a sixth embodiment of the present invention. The fluid element of the sixth embodiment is nearly the same as that of each of the first and the fourth embodiments with the exception that the fluid element has a liquid chamber 32 having a resistor thin film heating means 2, and active valves 81 and 82 adapted to be closed from the liquid chamber 32 side for flow paths 4*a* and 4*b* connected to the liquid chamber 32, and that a pulse voltage is applied to the resistor thin film heating means 2 with the active valves 81 and 82 being closed, thereby forming a supercritical state. An effect is obtained in which the volume expansion can surely be suppressed by the active valves 81 and 82.

Seventh Embodiment

Figure 9:
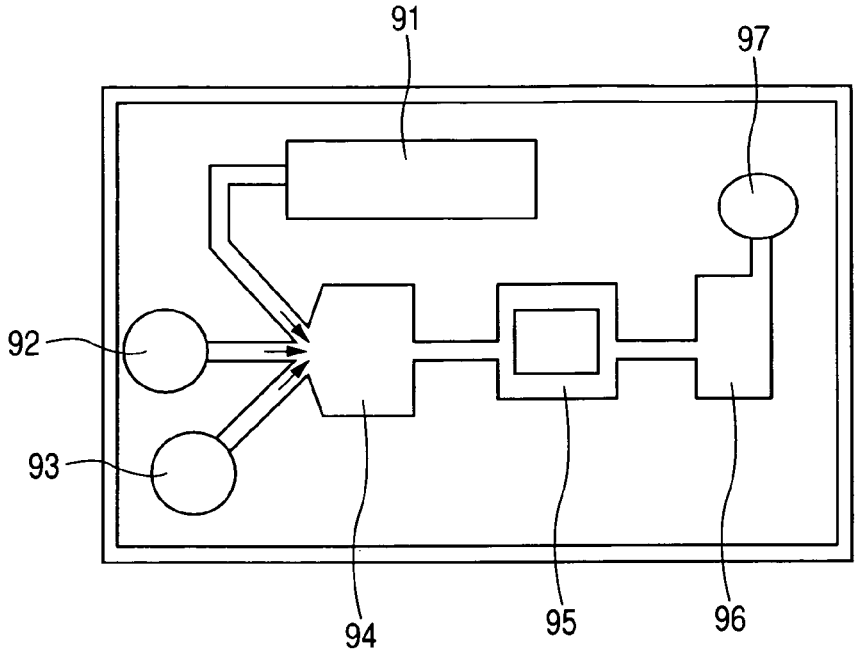
FIG. 9 is a schematic view showing a fluid element according to a seventh embodiment of the present invention.

FIG. 9 is a schematic view showing the feature of a fluid element according to a seventh embodiment of the present invention. Reference numeral 91 designates an element such as a μTAS formed on the same substrate that generates a waste liquid, reference numeral 92 designates a water storage chamber for additional injection, reference numeral 93 designates a storage chamber for an emulsifying agent, reference numeral 94 designates a liquid chamber for mixing the waste liquid, water, and the emulsifying agent with one another to form an emulsion, reference numeral 95 designates an element for treating the waste liquid using supercritical water, reference numeral 96 designates a treatment liquid preservation chamber, and reference numeral 97 designates a gas preservation chamber. The key feature of the fluid element of the seventh embodiment is such that the element that generates the waste liquid and the fluid element for generating the supercritical state in the flow path are disposed on the same substrate and are connected to each other through the flow path. Because the element that generates the waste liquid and the fluid element for generating the supercritical state and treating the waste liquid are formed integrally with each other on the same substrate, there is obtained an effect that even a micro quantity of waste liquid can be treated.

This application claims priority from Japanese Patent Application No. 2004-131569 filed Apr. 27, 2004, which is hereby incorporated by reference herein.

What is claimed is:

1. A microfluidic element comprising:

a micro flow path formed in a substrate for carrying a liquid as a fluid;

a liquid chamber connected to the micro flow path;

a heater unit provided in the liquid chamber to heat the liquid; and a voltage applying unit connected to the heater unit, wherein the liquid chamber and the heater unit are configured to raise a temperature of the liquid to 374° C. or more, and to increase a pressure of the liquid to 22 MPa or more, wherein the voltage applying unit is configured to apply to the heater unit a voltage pulse with a pulse width t0 represented by $$t0<((2AShd0)/\Delta P)^{0.5},$$

where A represents an inertance of the micro flow path for the heating unit, Sh represents an area of the heating unit, d0 represents a fluid movement allowance and is 1 μm, ΔP represents a pressure difference and is 22 MPa, and A is represented by ρL/S, where ρ represents a density of the liquid, L represents a length of the micro flow path, and S represents a cross-sectional area of the micro flow path, and wherein the heater unit is configured to force the liquid in the liquid chamber into a supercritical state repeatedly in a vicinity of a surface of the heater unit without forming any bubbles due to inertance of the liquid causing difficulty of movement of the liquid.

2. The microfluidic element according to claim 1, wherein the micro flow path has a high inertance for the heating unit.

3. The microfluidic element according to claim 1, wherein a cross-sectional area of the micro flow path is smaller than a cross-sectional area of the liquid chamber.

4. The microfluidic element according to claim 1, further comprising means for effecting heat storage and heat radiation connected to the heater unit, wherein heat storage and heat radiation are repeatedly carried out to repeatedly form the supercritical state.

5. The microfluidic element according to claim 1, further comprising an insulating thin film provided in contact with the heater unit, wherein the heater unit comprises a thin film resistor, and wherein the insulating thin film has a thickness d fulfilling the relation $$(vt0)^{0.5}<d<4(vt0)^{0.5},$$

where t0 represents a pulse width of a voltage pulse applied to the resistor thin film, and v represents a thermal diffusivity of the insulating thin film.

6. The microfluidic element according to claim 1, further comprising a first electrode and a second electrode in the micro flow path, wherein a voltage is applied between the first and the second electrodes to form an electric field in the micro flow path, thereby effecting heating.

7. The microfluidic element according to claim 1, wherein the liquid contains harmful substances and the harmful substances are decomposed by the supercritical state of the liquid.

* * * * *